United States Patent [19]

Mizutani

[11] Patent Number: 4,867,479

[45] Date of Patent: Sep. 19, 1989

[54] SLIDE FILE

[75] Inventor: Satoshi Mizutani, Tokyo, Japan

[73] Assignee: King Jim Co., Ltd., Tokyo, Japan

[21] Appl. No.: 222,762

[22] Filed: Jul. 21, 1988

[30] Foreign Application Priority Data

Dec. 14, 1987 [JP] Japan ..... 62-314109

[51] Int. Cl.[4] ..... B42D 3/10; B42D 3/18

[52] U.S. Cl. ..... 281/48; 281/42; 412/34

[58] Field of Search ..... 281/48, 15.1, 21.1, 281/29, 30, 31, 42, 22, 51; 412/34

[56] References Cited

U.S. PATENT DOCUMENTS 4,259,799 4/1981 Fulton, Jr. ..... 412/34 X 4,351,546 9/1982 Lognata ..... 412/34 X 4,575,123 3/1986 Giblin et al. ..... 412/34 X

FOREIGN PATENT DOCUMENTS 2448443 10/1980 France ..... 412/34

*Primary Examiner*—Paul A. Bell

*Attorney, Agent, or Firm*—Young & Thompson

[57] ABSTRACT

A slide file is disclosed, which comprises a file cover, a file board, a slender file base to which the respective one side end of the file cover and the file board are adhered, and an elastic slider with a sideways U-shaped transverse section extrapolated on the file base slidably in the width direction of the base and having upper and lower plates for opening or closing a paper clip portion communicated with a bonded portion of the file cover.

8 Claims, 2 Drawing Sheets

FIG. 3
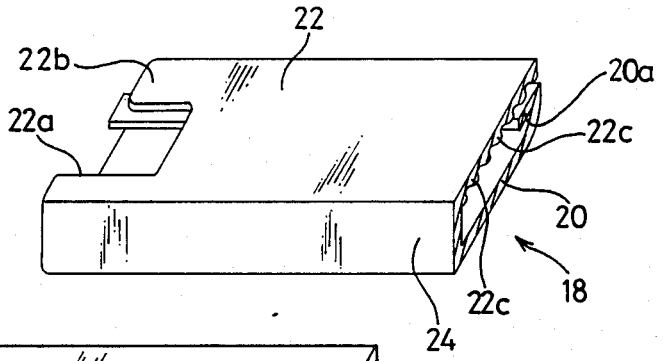
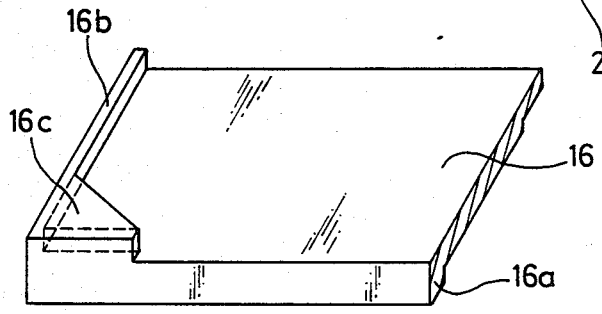
FIG. 4
FIG. 5
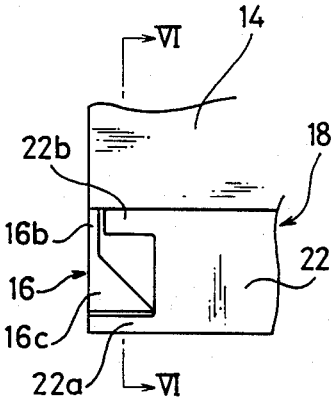
FIG. 6
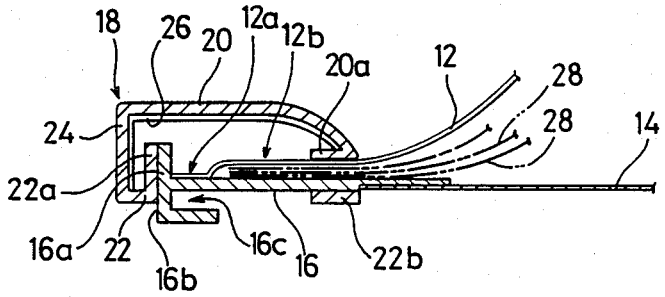
FIG. 7
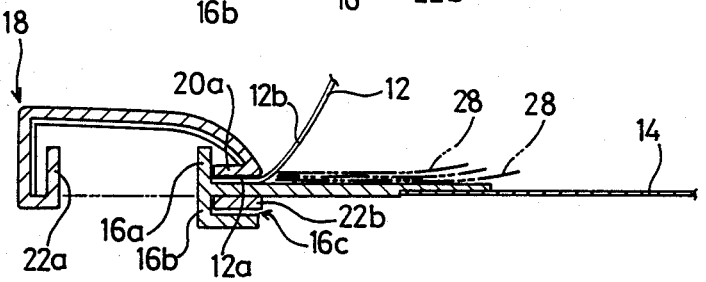

SLIDE FILE

FIELD OF THE INVENTION

The invention relates to a file for ordinary documents, particularly to a slide file for conveniently storing or releasing one or a few sheets of paper.

BACKGROUND OF THE INVENTION

Generally as a file for storing one or a few sheets of paper (hereinafter referred to as "a convenient file"), there have been used a file with a clip or lock as a binding device (hereinafter referred to as "a file of clip type") and a file with a binding rod fastener as a binding device (hereinafter referred to as "a file of binding rod type").

Comparing these convenient files with a thick file for storing a great volume of documents and the like, the whole thereof including a binding device has a simple structure of light weight. Furthermore, they are composed so as to conveniently take in or out the papers.

With regard to these conventional convenient file, however, there had been left some problems on simplicity of structure, operability of taking in or out the papers, safe-keeping and appearance of the whole file.

First of all, these convenient files each require a binding device, resulting in a comparatively complicated structure as well as a predetermined minimum thickness. Moreover, a fixture of the binding device to the file is exposed outside, thereby marring the appearance thereof and spoiling operability of the file, for example, of taking in or out.

Secondly, particularly with regard to the file of clip type, the length of the clip portion is limited, so that the binded papers get out of order or unstable, often resulting in a falling-off due to slippage. The file of binding rod type, on the other hand, requires a perforation of a binding aperture on the papers, while the operation of taking in or out thereby may not escape from complicatedness, and often the binding aperture is damaged.

Accordingly, the invention aims to provide a slide file for conveniently taking in or out and safe-keeping which is thinly formed of a simple structure and further has preferable appearance and operability.

SUMMARY OF THE INVENTION

In order to achieve the above object, the invention provides a slide file comprising a file cover, a file board, a slender file base to which the respective one side end of the file cover and the file board are adhered, and an elastic slider with a sideways U-shaped transverse section extrapolated on the file base slidably in the width direction of the base and having upper and lower plates for opening or closing a paper clip portion communicated with a bonded portion of the file cover.

In this case, the elastic slider may preferably be provided with the upper plate whose end is formed as an elastic pressure portion, while the file base may preferably be provided at the side end portion of its surface with a positioning rim for the elastic slider and at both sides of the larger direction of its back with a guide rim and a slippage prevention stopper for the elastic slider, and further the elastic slider at both sides of the larger direction of its lower plate is provided with a stopper correspondingly connected with the positioning rim and an engagement tongue piece slidably communicated with the guide rim forengaging with the slippage prevention stopper.

Furthermore, the elastic slider at the inner face of its lower plate may preferably be provided with a protuberant line of the longer direction to securely hold the elastic slider at its closed position. The elastic slider is integrally formed, while the file cover and the file board are adhered to the surface and the back of the file base respectively, and the file cover and/or the elastic slider may h=formed of transparent materials. The elastic slider at its inner face may be insertingly provided with an index sheet.

On sliding the elastic slider to its released position, all the papers binded between the file board and the cover may readily be released. On sliding it to its closed position, on the other hand, the papers on their overall width may be held by an elastic pressure member not to fall off due to slippage. The elastic slider is guided or engaged by means of a guide rim, a positioning rim, or a stopper provided in the slider or the base to smoothly and securely move between its released position and its closed position.

The file requires no special binding device, resulting in a simple structure and the thickness thereof is defined by that of the elastic slider to be thinly formed. No fixture is attached to the outer surface of the file, thereby improving both the appearance and the operability.

For better understanding, the invention will now be described hereinbelow in more detail with reference to the accompanying drawings.

BRIEF DESCRIPTION OF THE DRAWINGS

FIG. 3 is an enlarged perspective view of the rear end portion of an elastic slider of the slide file of FIGS. 1 and 2;

FIG. 4 is an enlarged perspective view of the rear end portion of a file base of the slide file of FIGS. 1 and 2;

FIG. 5 is a plan view of a joint end portion between the elastic slider and the file base of the slide file of FIG. 1 and 2;

FIG. 6 is an enlarged sectional view taken along VI—VI line in FIG. 5 for explaining the elastic slider at its closed position; and FIG. 7 is a sectional view corresponding to FIG. 6 for explaining the elastic slider at its released position.

PREFERRED EMBODIMENTS OF THE INVENTION

Figure 1:
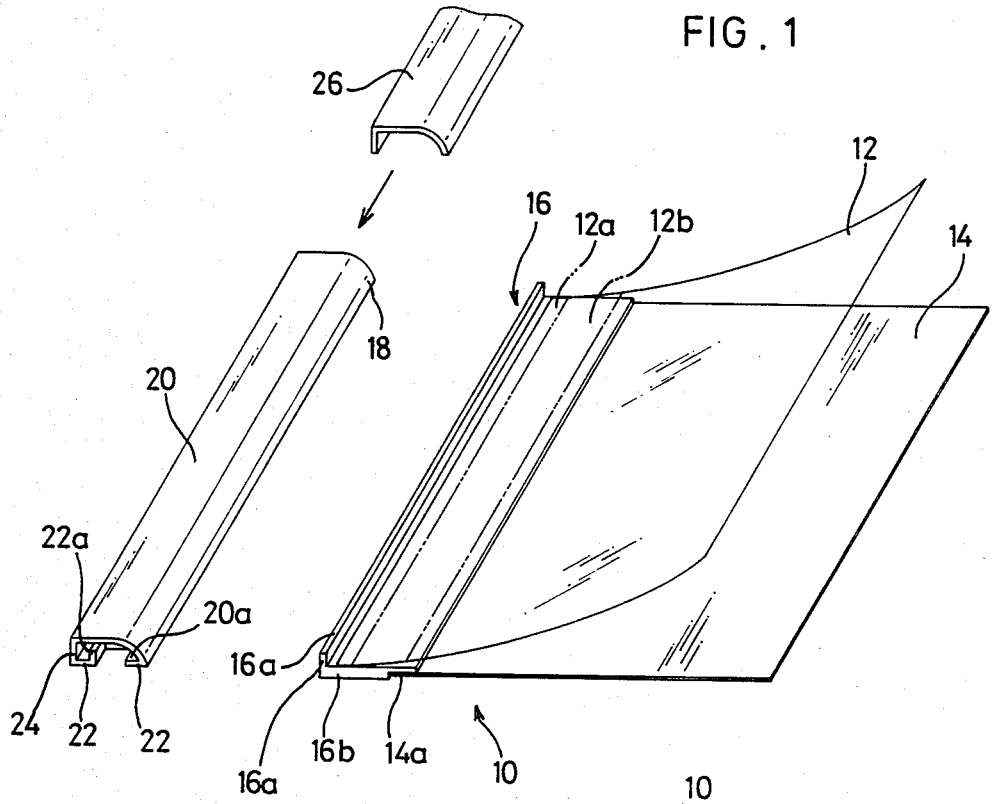
FIG. 1 is a disassembled perspective view of one embodiment of a slide file according to the invention.
Figure 2:
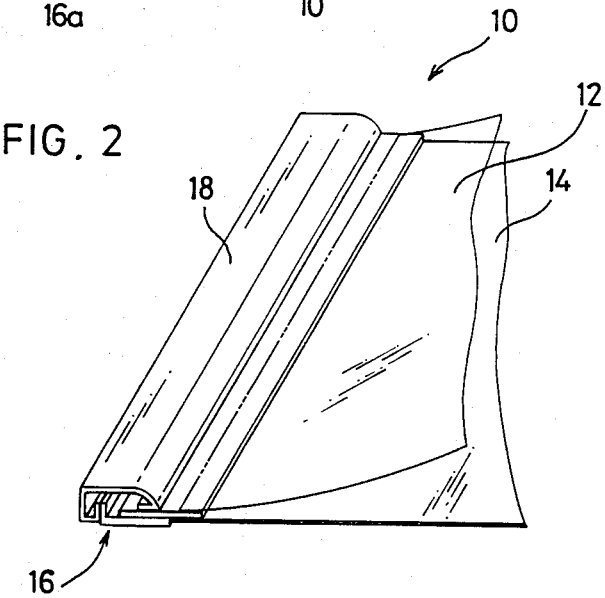
FIG. 2 is a partial perspective view illustrating an assembled state of the slide file of FIG. 1.

As shown in FIGS. 1 and 2, a slide file 10 according to the invention comprises a file cover 12, a file board 14, a slender file base 16 to which their bonded end portions 2*a* and 14*a* are adhered, and an elastic slider 18 with a sideways U-shaped transverse section extrapolated on the file base 16 slidably in the width direction of the base for opening or closing a paper clip portion 12*b* communicated with the bonded end portion 12*a* of the file cover 12.

The elastic slider 18, as shown in FIGS. 3, 5, 6 and 7, comprising an upper plate 20, a lower plate 22 and a side plate 24 is as usual integrally formed of transparent materials. The end portion of the upper plate 20 is formed as a bent elastic pressure portion 20*a* elastically movable between the position connected with the file base 16 (shown in FIG. 7) and a predetermined position of free choice (shown in FIG. 6). The lower plate 22 at both ends of the longer direction thereof is provided with a bent stopper 22*a* near the side plate 24 and at free ends thereof is provided U with an engagement tongue piece 22*b*, while inside the lower plate 22 is formed a protuberant line for frictional engagement 22*c* in the longer direction. Furthermore, the elastic slider 18 at its inner face is insertingly provided with an index sheet.

The file base 16, as shown in FIGS. 4 to 7, is provided at the side edge portion of its surface with a positioning rim 16*a*, at both ends of the longer direction of its back with a guide rim 16*b* and further at its corner with a slippage prevention stopper 16*c*.

On the slide file 10 thus constructed according to the invention, the bonded end portions 12*a* and 14*a* of the file cover 12 and the file board 14 are adhered to the predetermined positions in the surface and the back of the file base 16 and then the elastic slider 18 under the state wherein its open end portion is outstretched is extrapolated from the side portion of the file base 16.

When the elastic slider 18 slides, the end faces of the engagement tongue pieces 22*b* at both sides of the slider 18 are connectingly guided by the inner face of the guide rims 16*b* at both ends of the base 16, so that the slider 18 is smoothly and securely moved to the width direction of the base 16 under a state where it is pushed to be communicated with the base 16 through the elastic pressure portion 20*a*. Thus, when it arrives at its closed position for instance (as shown in FIG. 6), the bent stopper 22*a* is communicated with the outer face of the positioning rim 16*a*, so that the elastic slider 18 is engaged with the file base 16 accurately and securely at its closed position. In this case, the protuberant line for frictional engagement 22*c* also prevents the deviation of the elastic slider 18. In this condition, the elastic pressure portion 20*a* is lifted to a predetermined height on the paper clip portion 12*b* of the file cover 12 to equally and securely hold the papers 28 put between the cover 12 and the board 14 overall their width direction. When the elastic slider 18 arrives at its released position (as shown in FIG. 7), on the other hand, the inner end face of the elastic pressure portion 20*a* is communicated with the inner face of the positioning rim 16*a*, while the corner of the engagement tongue piece 22*b* is communicated with the corner inner face of the slippage prevention stopper 16*c* for accurately and securely engaging the elastic slider 18 with the file base 16 at its released position. In this case, the protuberant line for frictional engagement 22*c* also prevents the deviation of the elastic slider 18. In this condition, the elastic pressure portion 20*a* is descended to be communicated with the bonded end portion 12*a* of the file cover 12. Accordingly, all the papers 28 may readily be removed. Thus, on a slide file according to the invention, the papers may be not only conveniently taken in or out but also safely kept without slippage or damage thereof.

Furthermore, a slide file thus constructed according to the invention comprises an elastic slider and a file base integrally formed without known binding device necessary for the conventional one, resulting in a simple structure to provide at a lower cost. The thickness of the file is defined by that of the elastic slider to be thinly formed. Moreover, the file at its outer surface may have no fixture, resulting in improvement on both appearance and operability. In this case, an index sheet for index indication may be insertingly provided on the upper and side plates inside the transparent elastic slider and the file cover also may be formed of transparent materials, resulting in easy search for files.

As described hereinbefore, a slide file according to the invention comprises a slide base for holding a file cover and a file board in their position and an elastic slider extrapolated on the file base slidably in the width direction for opening or closing a paper clip portion of the file cover, so that the papers may conveniently be taken in or out only by sliding the elastic slider. Furthermore, in case of storing the papers, the end portion thereof over the length may equally and strongly h=held, thereby surely preventing the damage produced due to slippage or take-out of the papers. In addition, a slide file according to the invention comprises an elastic slider and a base integrally formed without known binding device necessary for the conventional one, resulting in a simple structure easy of assembling to provide at a lower cost. The file may be formed at a minimum of thickness and improved on appearance and operability.

What is claimed is:

1. A slide file comprising a file cover 12, a file board 14, a slender file base 16 to which the respective one side end of the file cover 12 and the file board 14 are adhered, and an elastic slider 18 with a sideways U-shaped transverse section extrapolated on the file base 16 slidably in the width direction of the base 16 and having upper and lower plates 20, 22 for opening or closing a paper clip portion 12*b* communicated with a bonded portion 14*a* of the file cover 12.

2. A slide file according to claim 1, wherein the elastic slider 18 is provided with the upper plate 20 whose end is formed as an elastic pressure portion 20*a*.

3. A slide file according to claim 1, wherein the file base 16 is provided at the side end portion of its surface with a positioning rim 16*a* for the elastic slider 18 and at both sides of the larger direction of its back with a guide rim 16*b* and a slippage prevention stopper 16*c* for the elastic slider 18, and further the elastic slider 18 at both sides of the larger direction of its lower plate 22 is provided with a stopper 22*a* correspondingly connected with the positioning rim 16*a* and an engagement tongue piece 22*b* slidably communicated with the guide rim 16*b* for engaging with the slippage prevention stopper 16*c*.

4. A slide file according to claim 1, wherein the elastic slider 18 at the inner face of its lower plate 22 is provided with a protuberant line 22*c* of the longer direction for frictional engagement.

5. A slide file according to claim 1, wherein the elastic slider 18 is integrally formed.

6. A slide file according to claim 1, wherein the file cover 12 and the file board 14 are adhered to the surface and the back of the file base 16 respectively.

7. A slide file according to claim 1, wherein the file cover 12 and/or the elastic slider 18 may be formed of transparent materials.

8. A slide file according to claim 7, wherein the elastic slider 18 at its inner face may be insertingly provided with an index sheet 26.

* * * * *